United States Patent [19]

Shaw et al.

[11] Patent Number: 5,060,490

[45] Date of Patent: Oct. 29, 1991

[54] ROTARY DYEING SYSTEM

[75] Inventors: Stephen K. Shaw, Winston-Salem, N.C.; Calvin C. Allen, Clarksville, Ak.; Constantin Anastase, Wichita Falls, Tex.

[73] Assignee: White Consolidated Industries, Inc., Cleveland, Ohio

[21] Appl. No.: 437,642

[22] Filed: Nov. 17, 1989

[51] Int. Cl.[5] ..... D06B 5/24; D06B 23/14

[52] U.S. Cl. ..... 68/27; 68/48; 68/145

[58] Field of Search ..... 68/27, 48, 143, 145; 34/109; 134/120, 159

[56] References Cited

U.S. PATENT DOCUMENTS

| | | | |
|---|---|---|---|
| 415,890 | 11/1989 | Weldon | 68/143 |
| 492,823 | 3/1893 | McIntosh | 68/143 X |
| 2,088,915 | 8/1937 | Manchester | 68/143 |
| 2,197,100 | 4/1940 | Downes | 68/143 X |

FOREIGN PATENT DOCUMENTS

| | | | |
|---|---|---|---|
| 2822983 | 11/1979 | Fed. Rep. of Germany | 68/143 |
| 25986 | 1/1907 | United Kingdom | 68/143 |

*Primary Examiner*—Philip R. Coe

*Attorney, Agent, or Firm*—Pearne, Gordon, McCoy & Granger

[57] ABSTRACT

In a rotary dyeing system for dyeing hosiery articles, a rotary cylinder is divided into a plurality of compartments for receiving bundles of dry articles therein. Each compartment is provided with a pivotable plate means which, upon wetting of the articles and shrinkage thereof, is forced during the dyeing cycle against the articles to maintain them compact and stationary to prevent tangling thereof.

15 Claims, 3 Drawing Sheets

ROTARY DYEING SYSTEM

BACKGROUND, BRIEF SUMMARY, AND OBJECTS OF THE INVENTION

This invention relates generally to rotary dyeing machines and more particularly to a new and improved dyeing system for effectively reducing the tangling of goods being dyed and retaining the goods in an oriented manner.

The invention will be described hereinbelow primarily with reference to the dyeing of hosiery. It is to be understood, however, that reference to hosiery or hosiery articles is not to be construed as an indication that the invention is so limited but is intended to include various articles and garments such as pantyhose, tights, socks, ladies conventional stockings, knee high garments and the like.

In conventional dyeing of hosiery, a series of bags are filled with light flexible articles, and the bags packed into the chamber of a rotary dyeing machine. The machine is filled with a dye bath and the bags moved in a generally circular path upon rotation of the machine cylinder. Wetting of the articles with the dye bath results in the articles becoming more compact, and coupled with the rotary displacement of the bags in the chamber, the bags and articles therein have room to move about resulting in tangling of the articles.

In the present invention, as the articles tend to be more compact and occupy less space due to being wet with the dye bath, means are provided for effectively selectively reducing the size of the chamber within which the bags are located thus maintaining the bags in close, compact association with each other and substantially eliminating tangling of the individual articles with each other. This, in turn, reduces product damage. Also, the articles are retained in an oriented, orderly fashion within the bags which facilitates handling of the articles in subsequent work operations. The chamber is divided into plural compartments by a partition means and each compartment is provided with a plate which normally abuts bags of articles within the compartment but which is capable of displacement for reducing the effective size of the compartment. The plate may be hinged adjacent one edge to the partition means with the opposite edge portion being permitted to swing in an arc in close proximity to the inner surface of the cylinder peripheral wall defining the compartment. The plate and bags are displaced as the cylinder rotates to reduce the amount of space within which the bags are retained, and a latch means may be provided to prevent the plate from returning back to its original position until completion of the dyeing cycle. A fluid means may be provided to urge the plate in a direction to reduce the effective size of the chamber upon shrinkage of the bags of articles. A stop mechanism may also be provided to limit the maximum extent that the plate may pivot so as not to over-compact the bags of hosiery.

The primary object of the invention is the provision of a new and improved dyeing system which significantly reduces tangling of the goods and retains them in an oriented manner during the dyeing process.

Another object of the invention is the provision of a means for, in effect, reducing the space occupied by the goods during the dyeing cycle to restrict movement of the bags and goods therein.

Still another object of the invention is the provision of a new and improved machine for dyeing delicate, flexible articles which results in less damage to the goods and reduced costs.

Other objects and advantages of the invention will be readily apparent to those skilled in the art during the course of the following detailed description.

DETAILED DESCRIPTION OF THE INVENTION

Figure 1:
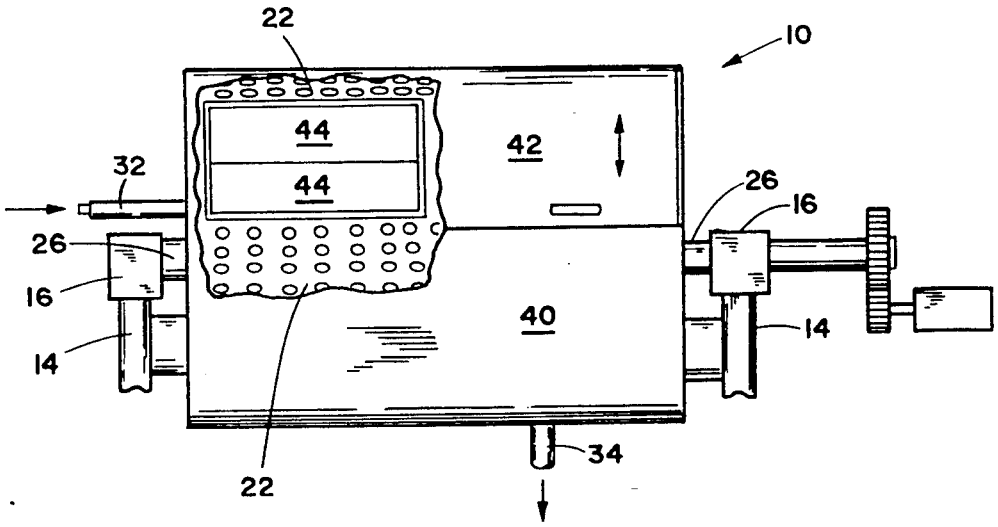
FIG. 1 is a schematic, front elevational view, with portions broken away, of the dyeing machine.

Referring initially to FIG. 1, number 10 generally represents the dye vat or dyeing machine which includes a stationary, generally cylindrical casing or housing 12 mounted upon standards 14 provided with conventional bearing members 16.

Figure 3:
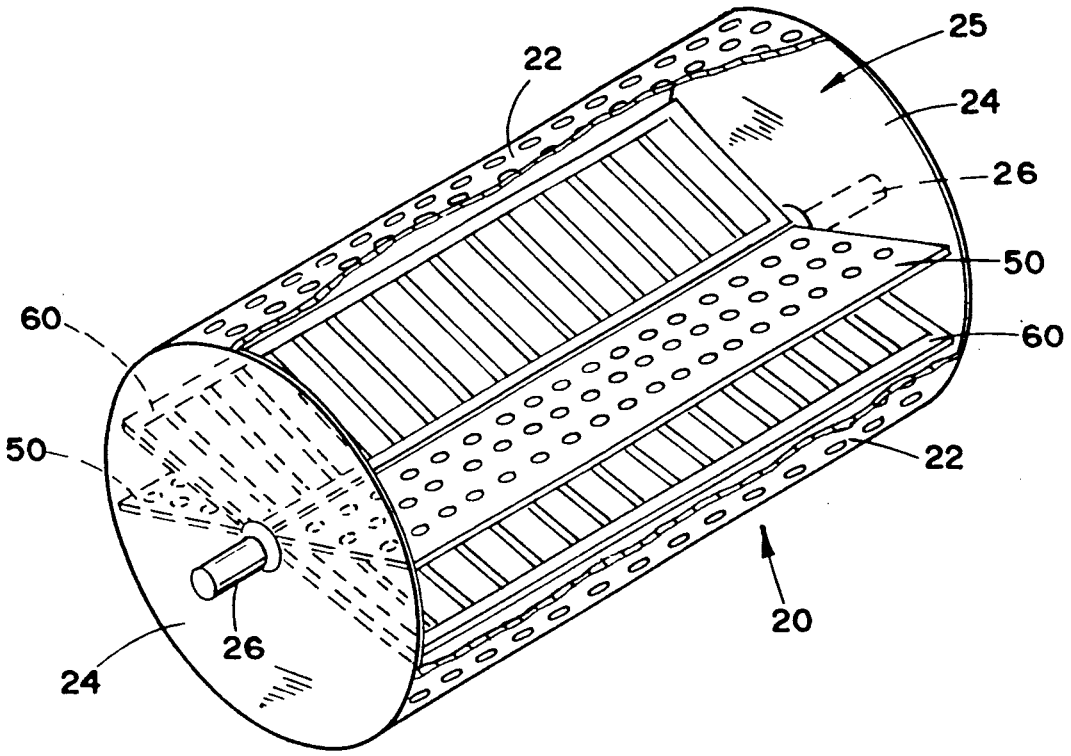
FIG. 3 is a fragmentary, schematic, perspective view, with parts broken away, of the machine cylinder.

Referring to FIG. 3, a cylinder 20 is rotatably mounted upon a horizontal axis within the casing 12. The cylinder 20, having a perforated, peripheral wall 22, is provided with end heads 24 thus defining a chamber 25. The end heads 24 are provided with suitable shaft members 26 rotatably received in the bearing members 16, and variably driven through gearing or other suitable means from a drive motor 28.

A suitable dye bath and other liquids may be directed into the dye vat through inlet conduit 32 and removed from the vat via drain line 34. Conventional controls, pumps, control valves, etc. may be provided for the dyeing, rinsing, and finishing phases of the operation, including circulating of the liquids to and from the machine. The dye or dyes employed in a particular operation will vary depending upon the nature of the fibrous materials being dyed, i.e., whether synthetic or natural fibers, and a number of manufacturing variables and preferences.

Figure 2:
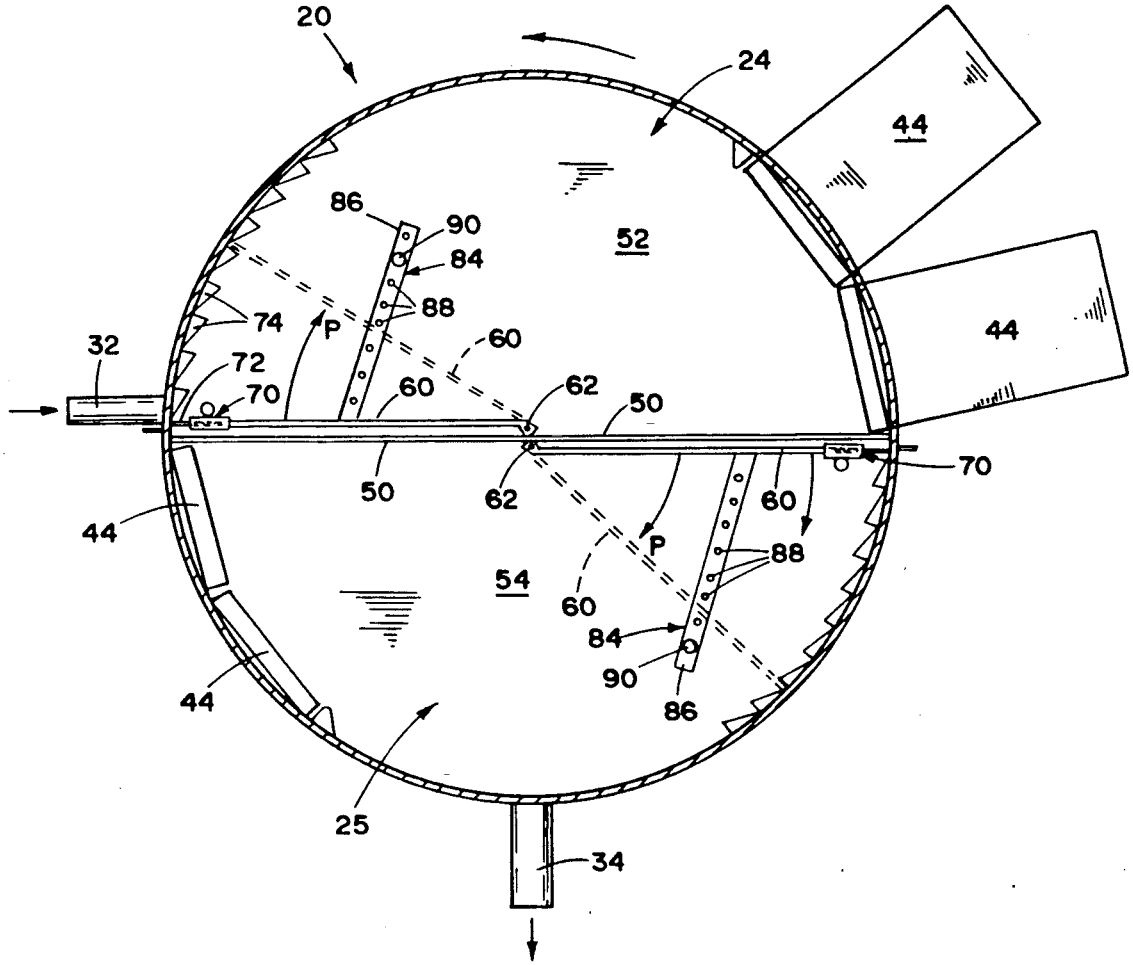
FIG. 2 is an enlarged, schematic, sectional view taken from one end of the machine cylinder illustrating one embodiment of an assembly for variably reducing the amount of space within which bags of hosiery are located during the dyeing cycle.

In order to provide access to the cylinder 20, the casing 12, which is of conventional construction, includes a fixed lower portion 40 and an upper pivotable or slidable door or closure 42. As shown in FIG. 2, the cylinder 20 is provided with sets of diametrically opposed doors 44 for providing access to the chamber 25. In FIG. 2, one set of doors at the right are in the opened positions and the set of doors to the left are closed.

It is to be noted that a conventional perforated or otherwise open-work type construction partition 50 extends between end walls 24,24 and diametrically across the chamber 25 with opposite ends secured in a suitable manner to the peripheral wall 22 of the cylinder. The partition divides the chamber into two equal compartments 52 and 54. Note that one set of doors 44 provide access to compartment 52 while the diametrically opposite set of doors provide access to compartment 54.

Within each of the compartments 52 and 54 is a displaceable, generally rectangular plate 60. Each plate 60 extends generally from one end plate 24 to the other and is hinged along one edge portion in a conventional manner as at 62 to the partition 50 and in close proximity to the axis of rotation of the cylinder. The plates 60 may be of various types of open-work construction permitting fluids to pass freely therethrough.

In the embodiment of FIG. 2, upon rotation of the cylinder 20 in a counterclockwise direction, centrifugal force moves the plates 60 from the solid line positions along paths indicated by arrows P to, in effect, reduce the sizes of compartments 52 and 54. A latch mechanism 70 is provided for each plate 60 to prevent the plate from moving back to its original position. Also, an adjustable stop assembly 84 is provided to selectively vary the maximum extent of pivotable displacement of the plate.

Figure 4:
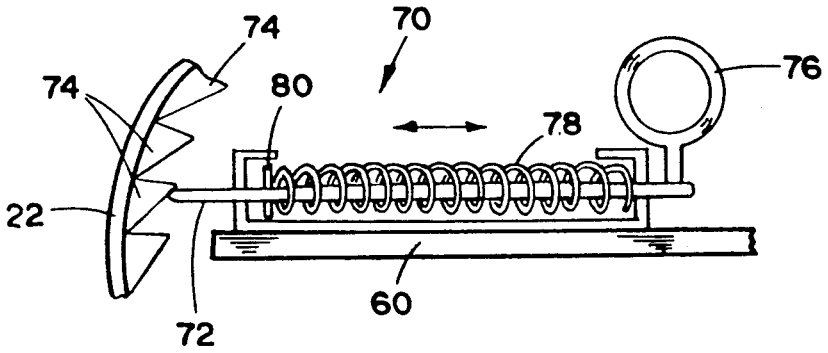
FIG. 4 is an enlarged view of a latching mechanism for the pivotable plate.

As illustrated in FIGS. 2 and 4, each latch assembly includes a spring biased plunger mechanism 72 fixed to the plate 60 and a series of ratchet teeth 74 secured to the inner surfaces of the peripheral wall 22 of the cylinder 20. Member 76 is provided to be gripped by an operator to overcome the pressure of spring 78 acting on the plunger plate 80 to move the plunger to the right, FIG. 4, to disengage the teeth 74 and permit the plate 60 to be returned to the full line position, FIG. 2. Other types of latch assemblies could be employed equally well. Also, a latch assembly could be employed at each end of each pivotable plate 60.

Each adjustable stop assembly 84 includes an elongated member 86 suitably secured by welding or other fasteners to an end plate 24 and having a series of openings 88 therein for selectively, releasably receiving a stop element 90. The element 90 extends outwardly into the path of displacement of the moveable plate 60 for engagement thereby. Positioning the element 90 within a selected opening 88 serves to limit the extent of movement of plate 60 to a desired extent. A stop assembly 84 may be provided to limit the movement of each end of each plate.

Figure 5:
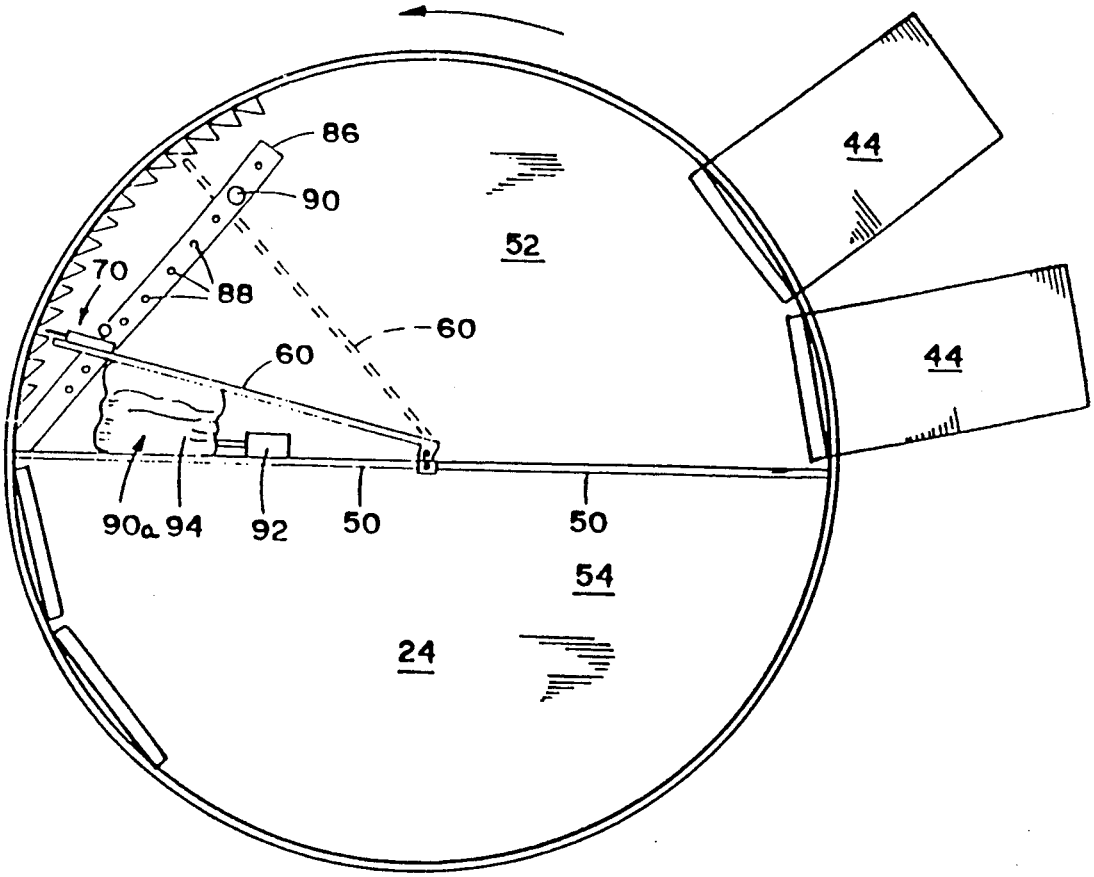
FIG. 5 illustrated another embodiment of an assembly for variably effectively reducing the size, during the dyeing cycle, of the compartment housing the goods being dyed.

FIG. 5 illustrates another embodiment of the invention for effectively reducing the size of a compartment, within which garments or hosiery articles are placed, during a dyeing operation by applying a biasing force to the hinged plate. As illustrated, a fluid mechanism **90*a* may be provided to act between a partion 50 and a hinged plate 60. A fluid under a predetermined, selected pressure may be directed from a suitable source 92 to an expandable bag 94 such that upon shrinking of the bags of hosiery articles due to the wetting by the dye bath and centrifugal force applied to the bags upon rotation of the cylinder, such pressure is sufficient to urge plate 60 away from partition 50** such that the plate is maintained in contact with the bags to apply pressure thereto.

The fluid assembly **90*a* urges the plate 60 in a direction to reduce the amount of space that the bags occupy. Maintaining pressure on the bags as taught by the embodiments of FIGS. 2 and 5** prevents the bags and delicate, flexible articles therein from moving with a compartment, thus reducing tangles and consequently picks, while maintaining the articles in an oriented manner within the bags.

The embodiment of FIG. 5 may also be provided with a latch assembly 70 and a stop assembly 84 if so desired.

Alternatively, rather than a bag 94, a fluid cylinder could be utilized to apply pressure to the plate 60. A spring assembly could also be employed to apply a biasing force to the plate.

While only one pressure applying means, that in compartment 52, has been shown on FIG. 5, it is to be understood that such means would also be provided in compartment 54. Further, while the chamber 25 of cylinder 20 has been shown as being divided into two compartments, it is to be understood that additional partitions 50 and sets of doors 44 could be provided to divide such cylinder chamber into three, four or more compartments.

In the operation of the machine, the door 42 is moved to the open position to provide access to the cylinder 20 and the cylinder is positioned with one set of doors 44 in the opening. The doors are opened providing access to a compartment and bags filled with dry hosiery articles are loaded to fill the compartment. The doors are closed, the cylinder is rotated to a predetermined position and bags are loaded into another compartment. Upon loading of all compartments, a dye bath is directed into the machine. Wetting of the bags and articles therein causes them to shrink or reduce in size, thus providing extra space within the compartment. Upon rotation of the machine cylinder centrifugal force tends to move the bags towards the rear of the compartments (in the direction of rotation of the cylinder) and a force is applied to the plates 60 to move them into engagement with the bags, reducing the sizes of the compartments and preventing excessive bag movement. The plungers 72 and ratchet teeth 74 prevent retractive movement of the plates until released by an operator after the dyeing operation.

It is to be understood that the invention is susceptible to various changes and modifications without departing from the scope of the invention as defined in the appended claims.

What is claimed is:

1. A machine for dyeing flexible fabric articles which shrink as they become wetted during the dyeing process, comprising a vat for containing a dye bath in which the articles are wetted during the dyeing process, a cylinder mounted in said vat, said cylinder defining a chamber, means dividing said chamber into a plurality of compartments for receiving unwetted articles to be dyed, and means effectively reducing the size of each compartment as said machine operates, causing said articles to be wetted and shrink, eliminating excessive movement of said articles within said compartment.

2. A machine as recited in claim 1, wherein said means effectively reducing the size of each compartment comprises a displaceable, open-work plate member coupled to said means for dividing said chamber into a plurality of compartments.

3. A machine as recited in claim 2, and further including means within each compartment for biasing said plate member into engagement with said fabric articles.

4. A machine as recited in claim 2, and further including means to limit the extent of displacement of each plate member while the machine continues to operate.

5. A machine as recited in claim 4, and further including releasable latch means to prevent each plate member from moving to increase the effective size of the associated compartment housing wet fabric articles.

6. A machine as recited in claim 2 wherein said means effectively reducing the size of each compartment includes biasing means for positively urging said plate members in a direction to reduce the associated compartment space occupied by wetted fabric articles.

7. A machine as recited in claim 6, wherein said biasing means comprises fluid means.

8. A rotary dyeing machine for fabric articles which shrink as they become wetted during the dyeing process, comprising a cylindrical tank defining a chamber for receiving a dye bath therein, means for mounting said cylindrical tank for rotation, means for rotating said tank at a selected speed, said tank further including door means for providing access to said tank chamber, partition means for separating said chamber into a plurality of compartments, said door means permitting the loading of unwetted fabric articles to be dyed within said compartments, and means for reducing the size of said compartments as said articles are wetted and shrink, eliminating excessive movement of said articles within said compartments.

9. A rotary dyeing machine as recited in claim 8, wherein said means for reducing the size of the compartments including an open-work plate, means hingedly mounting said plate to said partition means adjacent the axis of rotation of said cylindrical tank, said plate being displaced by centrifugal force upon rotation of said cylindrical tank to engage and compact fabric articles within the chamber, and latch means to prevent displacement of said plate in a direction away from said fabric articles.

10. A rotary dyeing machine as recited in claim 9, and further including means applying a positive biasing force to said plate.

11. A rotary dyeing machine as recited in claim 10, wherein said means applying a positive biasing force to said plate comprising fluid means positioned intermediate said plate and said partition means.

12. In the dyeing of textile goods wherein bundles of dry articles are subjected to a dye bath during a dyeing cycle and maintained in a controlled, compact position to prevent tangling of the articles comprising, a rotary dyeing machine including a casing, a cylinder rotatably mounted within said casing and defining a chamber for receiving articles and a dye bath, means for selectively rotating said cylinder and articles placed therein, said casing having means for directing fluids thereto and for permitting discharge therefrom, said cylinder further including a plurality of door means for providing access to said cylinder chamber for facilitating loading of articles therein, partition means within said cylinder for separating said chamber into a plurality of compartments, each of said compartments being of a size to receive therein bundles of dry textile articles to be dyed, plate means within each of said compartments, each said plate means including a generally rectangular plate of open-work construction extending from adjacent the axis of rotation of said cylinder radially outwardly to a position in close proximity to cylinder outer peripheral wall, means pivotably mounting said plate to said partition means along a first edge portion, said plate having an opposed second edge portion adapted to be displaced by centrifugal force relative to said cylinder peripheral wall upon rotation of said cylinder, latch means for retaining said second edge portion of said plate in various positions relative to said partition means, said bundles of articles upon being wetted by the dye bath shrinking in size and being compacted with a reduced volume compartment due to centrifugal force upon rotation of said cylinder.

13. In the dyeing apparatus of claim 12, means applying a biasing force to said plate to effectively reduce the size of the compartment housing the wetted articles.

14. In the dyeing apparatus of claim 12, latch means for retaining said plate second edge portion in various positions relative to said partition means.

15. In the dyeing apparatus of claim 14, said latch means including a spring biased plunger secured to said plate means and a series of ratchet teeth secured to the inner surfaces of said cylinder peripheral wall.

* * * * *

UNITED STATES PATENT AND TRADEMARK OFFICE

CERTIFICATE OF CORRECTION

PATENT NO. : 5,060,490

DATED : October 29, 1991

INVENTOR(S) : Shaw et al.

It is certified that error appears in the above-identified patent and that said Letters Patent is hereby corrected as shown below:

Col. 2, line 19, "illustrated" should be --illustrates--;

Col. 2, line 27, "number" should be --numeral--.

Signed and Sealed this

Sixteenth Day of March, 1993

*Attest:*

STEPHEN G. KUNIN

*Attesting Officer*

*Acting Commissioner of Patents and Trademarks*